United States Patent [19]

Uchida et al.

[11] Patent Number: 4,781,631

[45] Date of Patent: Nov. 1, 1988

[54] SUPPORTING DEVICE FOR MARINE PROPULSION APPARATUS

[75] Inventors: Tatsuki Uchida; Ryoji Nakahama, both of Hamamatsu, Japan

[73] Assignee: Sanshin Kogyo Kabushiki Kaisha, Hamamatsu, Japan

[21] Appl. No.: 28,896

[22] Filed: Mar. 23, 1987

[30] Foreign Application Priority Data

Mar. 24, 1986 [JP] Japan ..... 61-65187

[51] Int. Cl.[4] ..... F16M 1/02

[52] U.S. Cl. ..... 440/63; 440/61; 440/53; 248/642

[58] Field of Search ..... 440/53-56, 440/61-65, 49

[56] References Cited

U.S. PATENT DOCUMENTS

| | | | |
|---|---|---|---|
| 3,567,164 | 3/1971 | Schueneman | 440/63 |
| 3,990,660 | 11/1976 | Pipoz | 440/61 |
| 4,624,438 | 11/1986 | Goodman | 440/61 |
| 4,682,961 | 7/1987 | Wakahama | 440/61 |

FOREIGN PATENT DOCUMENTS

| | | | |
|---|---|---|---|
| 0105071 | 4/1984 | European Pat. Off. | 440/63 |
| 2035934 | 6/1980 | United Kingdom | 440/63 |

*Primary Examiner*—Joseph F. Peters, Jr.
*Assistant Examiner*—Clifford T. Bartz
*Attorney, Agent, or Firm*—Ernest A. Beutler

[57] ABSTRACT

A number of embodiments of supporting devices for marine propulsion apparatus wherein the path of movement of the outboard drive may be adjusted through an adjustable pivotal connection of the supporting linkage system.

9 Claims, 5 Drawing Sheets

SUPPORTING DEVICE FOR MARINE PROPULSION APPARATUS

BACKGROUND OF THE INVENTION

This invention relates to a supporting device for a marine propulsion apparatus and more particularly to an improved supporting arrangement for a marine propulsion apparatus that permits a wider variety in the selection in the movement of the propulsion device relative to the associated watercraft.

It is well known to mount a marine outboard drive, such as an outboard motor, for movement relative to the transom of an associated watercraft between a plurality of trim adjusted positions and a tilted up out of the water condition. The simplest of such supporting arrangements comprises a single pivot pin about which the outboard drive pivots. Although such arrangements have the advantages of simplicity, they do present certain disadvantages. For example, the range of movement of the outboard drive is limited by the single pivot point and the outboard drive swings through a substantially greater arc than is necessary in order to tilt the outboard drive up to its out of the water position.

There have been proposed, therefore, systems wherein the outboard drive is supported by means of a pair of links so as to permit the same degree of vertical movement while limiting the amount of longitudinal movement of the outboard drive. Such an arrangement is shown in copending application Ser. No. 672,410, filed Nov. 16, 1984, entitled "Tilting Device For Outboard Engine", filed in the names of Ryoji Nakahama and Toshiyuki Yamazaki and assigned to the assignee of this application. Such systems have a substantial advantage in their operation. However, the optimum location traced by the propulsion unit depends on a wide variety of factors and a fixed double pivot arrangement as shown in that application may not be optimum for all of these applications.

It is, therefore, a principal object of this invention to provide an improved supporting device for a marine propulsion apparatus.

It is a further object of this invention to provide a supporting device for a marine propulsion apparatus that permits adjustment in the locus of movement of the outboard drive during its movement from its normal running condition through its trim adjusted positions to its tilted up out of the water condition.

It is a still further object of this invention to provide an improved linkage system for such a suspension arrangement that will achieve compact movement and which offers the desired adjustability.

Frequently, there are provided one or more fluid motors for achieving the movement of the outboard drive between its trim adjusted position and its tilted up position. Such fluid power assisted devices offer ease of operation, particularly when dealing with high horsepower or high power output systems. Of course, the aforenoted disadvantages are also present in such systems. Therefore, it is a still further object of this invention to provide an improved arrangement for supporting an outboard drive that is moved between its trim and tilt positions by a fluid motor and wherein the locus of movement can be easily and conveniently adjusted.

SUMMARY OF THE INVENTION

This invention is adapted to be embodied in a marine outboard drive that carries propulsion means. Supporting means are provided supporting the outboard drive for movement relative to the transom of an associated watercraft through a plurality of trim adjusted positions. In accordance with the invention, the supporting means includes at least one link having a pivotal connection to one of the outboard drive and the transom. The location of this pivotal connection is adjustable for changing the locus of movement of the outboard drive through its adjusted positions.

DETAILED DESCRIPTION OF THE PREFERRED EMBODIMENTS

Embodiment of FIGS. 1 through 6

Figure 1:
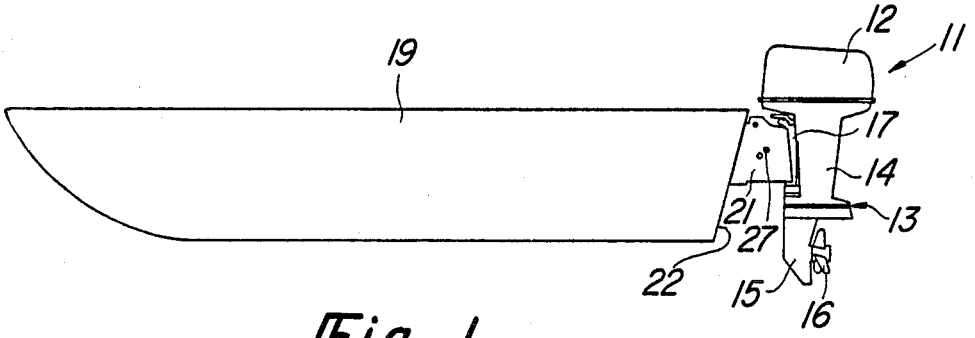
FIG. 1 is a side elevational view of a watercraft, outboard drive and supporting arrangement therefor constructed in accordance with an embodiment of the invention.

An outboard drive constructed in accordance with a first embodiment of the invention is shown in FIGS. 1 through 6. The term "outboard drive" as used herein is intended to cover either the outboard drive portion of an inboard/outboard assembly or an outboard motor per se. In accordance with the embodiments of the invention specifically illustrated and described, an outboard motor is the specific form of outboard drive with which the invention is embodied. It should be understood, however, that certain facets of the invention can be used in conjunction with the outboard drive portion of an inboard/outboard drive assemblage.

An outboard motor is indicated generally by the reference numeral 11 and includes a power head 12 in which an internal combustion engine of any known type may be positioned for providing the motive force for the outboard motor 11. The internal combustion engine drives a drive shaft (not shown) that extends through a housing assembly, indicated generally by the reference numeral 13, and which includes a drive shaft housing 14. A lower unit 15 depends from the drive shaft housing 14 and contains a suitable forward, neutral, reverse transmission for driving an appropriate propulsion device, such as a propeller 16 and its shaft. The drive shaft housing 14 is connected by means of a steering shaft (not shown) to a swivel bracket 17 for supporting the housing assembly 13 for steering movement about a generally vertically extending axis in a known manner.

Figure 2:
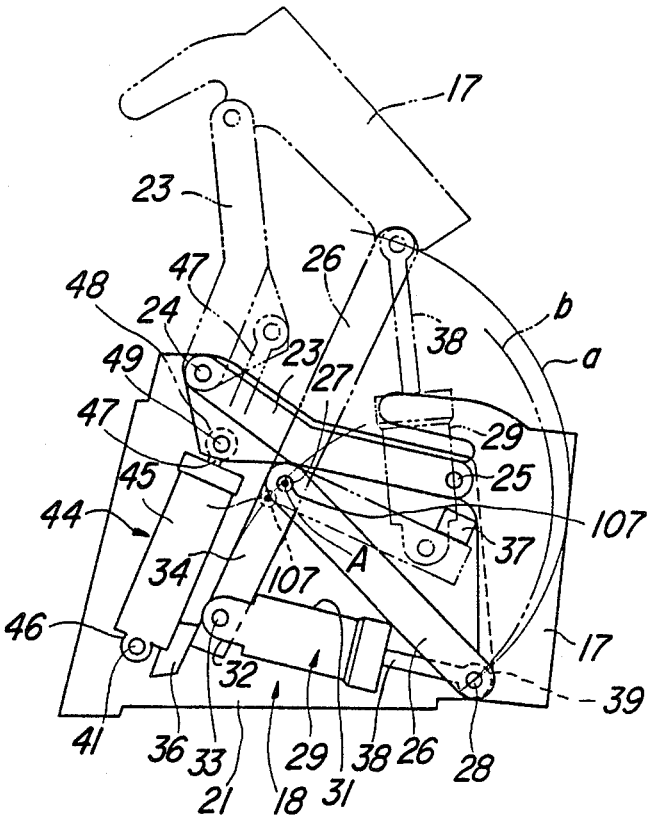
FIG. 2 is an enlarged side elevational view showing the supporting arrangement for the outboard drive in its normal running condition, in solid lines and in its tilted up out of the water condition (in phantom lines).
Figure 3:
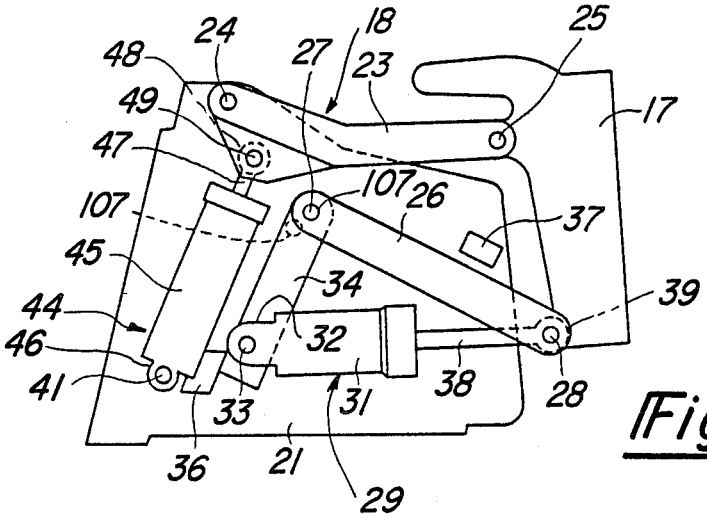
FIG. 3 is a side elevational view, in part similar to FIG. 2, showing the outboard drive supporting mechanism in its fully trimmed up position.
Figure 4:
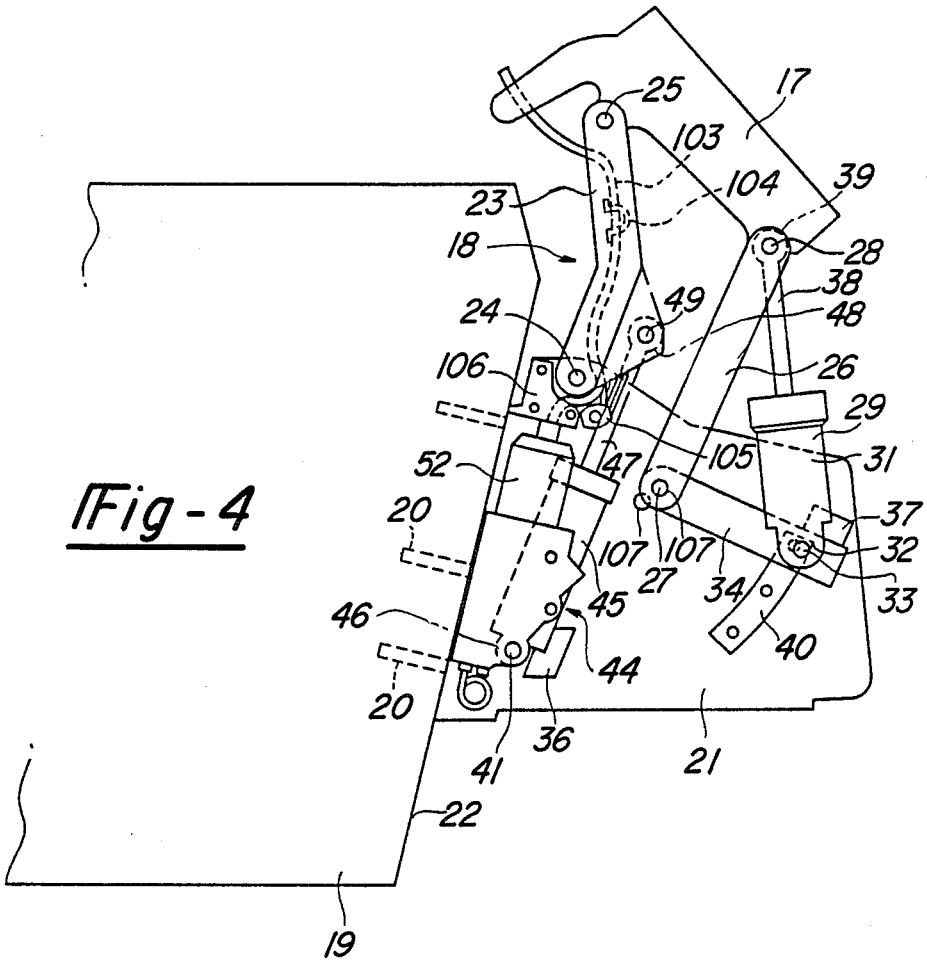
FIG. 4 is a side elevational view, in part similar to FIGS. 2 and 3, showing the outboard drive in its fully tilted up position and illustrating certain additional components.

A linkage assembly, indicated generally by the reference numeral 18 and shown in most detail in FIGS. 2 through 4, is provided for supporting the outboard motor 11 for tilting and trim movement relative to the associated watercraft, identified generally by the reference numeral 19. The linkage assembly 18 includes a base comprised of a bracket assembly 21 that is adapted to be clamped by bolts or studs 20 in a suitable manner to a transom 22 of the watercraft 19.

The linkage assembly 18 includes a first link 23 that has a generally dog leg shape and which is pivotally connected at one end, by means of a pivot pin 24, to the bracket assembly 21. The opposite end of the link 23 is pivotally connected to an upper portion of the swivel bracket 17 by means of a pivot pin 25. A second, generally straight, link 26 is pivotally connected at its forward end to the bracket 21 by means of a pivot pin 27. The opposite end of the link 26 is pivotally connected to the swivel bracket 17, by means of a pivot pin 28, at a point below the pivot pin 25.

The geometry of the linkage system 18 is chosen so that when the outboard motor 11 is swing through its trim range of positions, in the manner to be described, that the axis of rotation of the propeller 16 will be at the optimum angle to the associated watercraft 19 and at the appropriate height, in the manner as described in the aforenoted copending application Ser. No. 672,410. Also, the linkage arrangement 18 is such that when the outboard motor 11 is tilted to its fully tilted up position that the end of the lower unit 16 will not project as far to the rear of the transom 22 as if the outboard motor 11 were pivotal about a single horizontal axis, as with many types of prior art constructions. Again, reference may be had to copending application Ser. No. 672,410 for a description of the functioning and advantages of the linkage system 18.

The trim movement of the outboard motor 11 is achieved hydraulically by means of a hydraulic cylinder and piston type fluid motor, indicated generally by the reference numeral 29. The fluid motor 29 has a cylinder assembly 31 that is formed with a trunnion 32 at its lower end that accommodates a pivot pin 33 for pivotal connection to the lower end of a link 34. The upper end of the link 34 is pivotally connected to the bracket 21 by means of the pivot pin 27. The link 34 is pivotal between a lower position, as shown in solid line in FIGS. 2 and 3, wherein it engages a first stop 36 carried by the bracket 21 and an upper position, as shown in phantom lines in FIG. 2 and solid lines in FIG. 4, wherein it engages a second stop 37 carried by the bracket 21. This pivotal movement and the manner in which it is accomplished and its function will be described later. A plastic guide 40 (FIG. 4) is carried by the bracket 21 and engages the link 34 during a portion of its travel to stabilize its movement.

A piston, later to be described, is positioned within the cylinder assembly 31 and is connected to a piston rod 38 for effecting reciprocation of the piston rod 38 upon operation of the fluid motor 29. The piston rod 38 is formed with an eyelet 39 at its outer end that is pivoted to the link 26, by means of the pivot pin 28.

The trim movement of the outboard motor 11 is assisted and the tilting of it is accomplished by a tilt hydraulic cylinder and piston motor assembly, indicated generally by the reference numeral 44. The tilt motor assembly 44 includes a cylinder assembly 45 that has a trunnion 46 at its lower end for pivotal connection to the bracket 21 by means of a pivot pin 41. A hydraulically actuated piston, to be described, is contained within the cylinder assembly 45 and is connected to a piston rod 47 for effecting its reciprocation. The piston rod 47 is formed with an eyelet 48 at its outer end that affords a pivotal connection to the lever 23 by means of a pivot pin 49.

Figure 5:
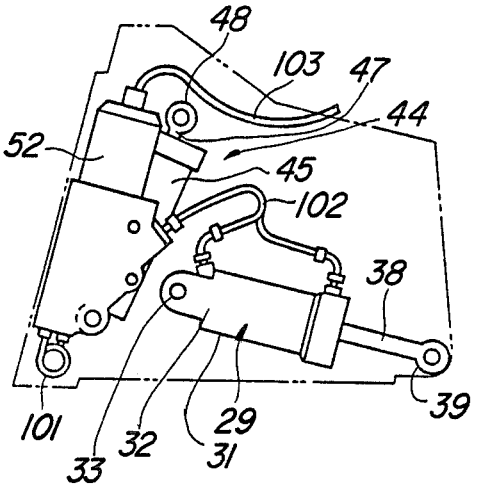
FIG. 5 is a side elevational view, in part similar to FIGS. 2 through 4, and shows the hydraulic arrangement.

The hydraulical circuitry for operating the tilt cylinder 44 and the trim cylinder 29 will now be described by particular reference to FIG. 6. This system includes a reversible positive displacement fluid pump 51 that is driven in opposite directions selectively by a reversible electric motor 52 (FIGS. 4 and 5). The pump 51 has a pair of ports 53 and 54 either of which can function as a pressure port with the other functioning as the suction port depending upon the direction of rotation of the motor 52 and pump 51. Makeup lines 55 and 56 communicate with a fluid reservoir 57 by means of check valves 58 and 59, respectively, so as to provide for makeup fluid, if required.

The ports 53 and 54 are connected by lines to a shuttle valve assembly 61 in which a shuttle piston 61 is provided. The shuttle piston 62 divides the internal chamber of the shuttle valve assembly 61 into a first chamber portion 63 that communicates with the port 53 and a second chamber portion 64 that communicates with the port 54. A check valve 65 is provided for controlling the flow from the chamber portion 63 to a further chamber portion (not shown) and then to a conduit 66. In a like manner, a check valve 67 controls the communication between the chamber portion 64 and a yet further chamber portion (not shown) to a conduit 68. The conduit 68 extends to the cylinder assembly 44 and specifically to a lower chamber 71 formed therein beneath a floating piston 72. The floating piston 72 cooperates with a main piston 73 that is affixed to the piston rod 47. The conduit 66 communicates the shuttle valve check valve 65 with a second chamber 75 formed in the tilt cylinder assembly 44 above the piston 73.

The piston assembly 73 is provided with a pressure responsive absorber valve assembly 76 that will permit flow from the chamber 75 to the portion of the chamber 71 above the floating piston 72 so as to permit the motor 11 to pop up and avoid damage if an underwater object is struck. When the underwater obstacle is cleared, the motor 11 may lower and fluid will be returned to the chamber 75 from the chamber 71 through a relief valve 77 provided in the piston 73. The absorber valve 76 requires a substantially higher pressure to open than does the relief valve 77. Preferably, the relief valve 77 opens at the pressure determined by the weight of the motor 11 so as to permit its return to the trim adjusted position once the underwater obstacle has been cleared, as aforenoted.

A further fluid line 78 extends from the line 68 to the trim cylinder assembly 29 and specifically to a chamber 79 formed below a floating piston 81 within the cylinder assembly 31. The floating piston 81 cooperates with a main piston 82 that is affixed to the piston rod 39. One or more passages 83 extend through the piston 82 so as to provide communication between the portion of the chamber 79 above the floating piston 81 and a chamber 84 formed above the piston 82.

The trim cylinder assembly chamber 84 is connected to the shuttle valve chamber 63 by means of a line 85. A pressure responsive check valve 86 is disposed in the line 85 for controlling the flow from the shuttle valve chamber 63 to the trim cylinder chamber 84. A parallel but oppositely acting check valve 87 is disposed in the line 85 for controlling the flow from the chamber 84 to the shuttle valve chamber 63. The check valve 87 opens at a substantially lower pressure than that required to open the pressure responsive valve 86.

A makeup check valve 88 connects the reservoir 57 with the chamber 84 for permitting makeup fluid to flow from the reservoir 57 into the chamber 84 during trim down operations.

The system further includes a trim tilt up relief valve 89 that interconnects the conduit 68 with the reservoir 57. This permits relief of the pressure in the line 68 and protection of the cylinders 29 and 44 in the event operation of the fluid pump 51 is not discontinued when the fluid motors reach the extreme limit of their tilt up stroke. The hydraulic circuit further includes a trim down relief line 91 that communicates the pump port 53 with the reservoir 57 for providing relief under the trim down condition in the event the motor 52 and pump 51 are not stopped when the pistons 73 and 81 reach the bottom extremities of their strokes.

A manually operated valve 92 is interposed between the lines 66 and 68 and communicates with the sump 57 so as to provide for manual tilting up of the outboard motor 11 without significant fluid resistance.

The operation of the device will now be described. The solid line view of FIG. 2 shows the condition of the linkage 18 when the outboard motor 11 is in its normal tilted, trimmed down running condition. At this condition, both the trim cylinder assembly 29 and tilt cylinder assembly 44 are at the one extreme positions of their strokes with the respective main pistons 82 and 73 and floating pistons 81 and 72 at the generally bottom portion of the cylinders 31 and 45, respectively.

If it is desired to effect trim up of the outboard motor 11, and this is normally done under running conditions, the motor 52 is energized so as to drive the pump 51 in a direction to pressurize the port 54 and cause the port 53 to act as a suction port.

Pressurization of the port 54 causes the shuttle piston 62 to move to the left and one of its two projections engages the ball of the check valve 65 and unseats it to open communication between the chamber portion 63 and conduit 66. Pressurization of the chamber portion 64 generates sufficient pressure to unseat the ball check valve 67 and permit flow to occur from the chamber portion 64 into the lines 68 and 78. Pressurization of the line 78 causes fluid to be delivered to the trim cylinder chamber 79 so as to urge the floating piston 81 and main piston 82 upwardly to extend the piston rod 39 and effect a pivotal force on the link 26. At the same time, the pressurization of the line 68 causes fluid to be delivered to the tilt cylinder chamber 71 so as to urge its floating piston 72 and main piston 73 upwardly so that the piston rod 47 exerts a force on the link 23 so as to effect its pivotal movement about the pivot pin 24. Thus, the fluid motors 29 and 44 act in parallel so as to sum their forces on the motor 11 to effect its tilting up.

When the tilt cylinder piston 73 moves upwardly, fluid is displaced from its chamber 75 through the line 66. Since the ball check valve 65 is unseated, this fluid may flow into the chamber portion 63 and back to the pump port 53 so as to provide the fluid to its suction side. Fluid displaced from the chamber 84 of the trim cylinder assembly 29 is expelled back to the shuttle valve chamber 63 and port 53 through the line 85 and past the check valve 87, which as has been noted, opens at a low pressure differential.

It should be noted that during this initial tilting movement of the outboard motor 11, the link 34 will be held in engagement with the stop 36 by both the pressure of the tilt cylinder 29 and the weight and driving thrust of the outboard motor 11. Since the tilt cylinder 29 and trim cylinder 44 act together, as aforenoted, they will generate sufficient pressure so as to achieve the trim adjustment even though high driving forces may be encountered. Because the two cylinders operate in parallel, it is possible to use smaller cylinders than were they not operative together. Also, as has been noted, the linkage system 18 is such that the proper angle for the propeller 16 relative to the hull 19 will be afforded at each respective trim position.

The trim adjustment may continue through the full range of the stroke of the trim cylinder 29 so as to effect maximum trim up as shown in the position of FIG. 3. In this regard, the trim cylinder 29 has a substantially lesser effective stroke than the tilt cylinder 44 so that the trim cylinder piston 82 will reach its upper limit well before the tilt cylinder piston 73 has reached its upper limit.

If the motor 52 and pump 51 are continued to be driven in the direction so as to pressurize the port 54 after full trim up position is reached, the motor 11 may be tilted up in the manner now to be described. If the line 68 is still pressurized after the trim cylinder 29 has reached the end of its stroke, fluid will still be supplied to the line 68 and the floating piston 72 and main piston 73 will be urged upwardly. During this movement and since the trim cylinder 29 is at the end of its stroke, the link 26 will continue to rotate as the link 23 is rotated and a lifting force will be exerted on the trim cylinder 29 through the pin 28 and piston rod 38. Movement is permitted since the link 34 that supports the lower end of the cylinder assembly 31 may pivot through an arc around the pivot pin 27 until the link 34 is moved into abutment with the stop 37 (FIG. 4 and phantom line view of FIG. 2). As noted, the guide 40 cooperates with the link 34 during this movement. At this time, the motor 11 will be in its tilted, trim up condition and further elevation is not possible. At this time, the trim cylinder 44 will have effectively reached the end of its stroke. It should be noted that in this condition, the piston rods 47 and 38 are disposed substantially above the water line so that they will not be fouled even if the motor 11 is left tilted up for long periods of time.

If the motor 52 and pump 51 are continuously operated after both of the cylinder assemblies 29 and 44 reach the limit of their upward stroke, the tilt up relief valve 89 will open, as aforenoted, and relieve the pressure back to the reservoir 57. This will prevent damage to the components of the circuit.

Tilting down operation from the position shown in phantom in FIG. 2 and in FIG. 4 is achieve by operating the motor 52 so as to drive the pump 51 in a direction that the port 53 is pressurized and the port 54 acts as a suction port. Pressurization of the port 53 causes fluid pressure in the shuttle valve chamber portion 63 to cause the shuttle piston 62 to move to the right so that its other projection will engage the ball check valve 67 and unseat it so as to open communication between the chamber portions 64 and the line 68. Thus, both the lines 68 and 78 will be opened to the suction port 54 of the pump 51.

Pressurization of the chamber 63 causes sufficient pressure to be generated so as to unseat the ball check valve 65 and open communication with the conduit 66. This causes fluid to flow into the tilt cylinder chamber 75 to urge the main piston 73 and floating piston 72 downwardly. Fluid is expelled from the chamber 71 back to the suction port 54 through the line 68 and chamber portion 64 past the opened check valve 67.

During the initial tilting down movement from the position shown in phantom shown in FIG. 2 and in FIG. 4, the cylinder 29 will remain in its expanded condition and the links 26 and 34 will pivot as a unit about the pivot pin 27. Under this condition, there is insufficient pressure generated in the chamber 63 so as to open the check valve 86 and permit flow to the chamber 84 of the motor 29 through the conduit 85. During this initial movement from the tilted up position, therefore, there will be rapid motion because all of the fluid delivered by the pump 51 will be transmitted directly to the tilt fluid motor 44.

When the link 34 has pivoted sufficiently so as to contact the stop 36, there will be an abrupt pressure rise in the line 63 and the check valve 86 will then open so that fluid can be delivered to the chamber 84 of the fluid motor 29. Thereafter, the piston 82 and floating piston 81 will be forced downwardly and fluid will be expelled from the chamber 79 through the line 68 back to the suction port 54 through the opened check valve 67 and chamber 64.

If the motor 52 and pump 51 are continuously operated until the outboard motor 11 reaches its fully tilted, trimmed down position, there will be an abrupt pressure rise at the port 53 and the tilt down check valve 91 will open so as to relieve this pressure and prevent damage.

As has been previously noted, the device also permits the motor 11 to pop up in the event of forward travel and the striking of an underwater obstacle. When this happens, there will be sufficient force generated on the piston rod 47 so as to overcome the pressure required to open the absorber valve 76 and fluid may flow from the chamber 75 to the area in the chamber 71 above the floating piston 72. During this movement, the trim cylinder assembly 29 will not undergo any expansion and the link 34 will merely rotate with the piston rod 38 and cylinder assembly 31 following the pivotal movement of the link 26 unless the link 34 contracts the stop 37. If this occurs, there will be some extension of the piston rod 39 and fluid will flow from the chamber 84 through the openings 83 to the area in the chamber 79 above the floating piston 81. Thus, in this stage, both tilt cylinder 44 and trim cylinder 29 will tend to resist the popping up action.

During the aforenoted movement, it should be noted that the floating pistons 72 and 81 will undergo substantially no movement and hence their positions will remain substantially fixed so as to form a memory for the return movement of the outboard motor 11.

When the obstacle is cleared, the relief valve 77 will open so as to permit reverse flow from the portion of the chamber 71 above the floating piston 72 back to the chamber 75. If the piston 82 has been extended, there will be a like flow from the area in the chamber 79 above the floating piston 81 back to the chamber 84 through the openings 83. Because the two cylinders act together to absorb the loads, the linkage system need not be as strong as with prior art arrangements wherein this is not done. Also, since the trim piston rod 39 is coupled to the linkage system 18, there will be no wear as with prior art arrangements wherein the trim cylinder piston rods were in abutting engagement with the outboard drive. Furthermore, the likelihood of bending of the trim cylinder piston rod is avoided.

Figure 6:
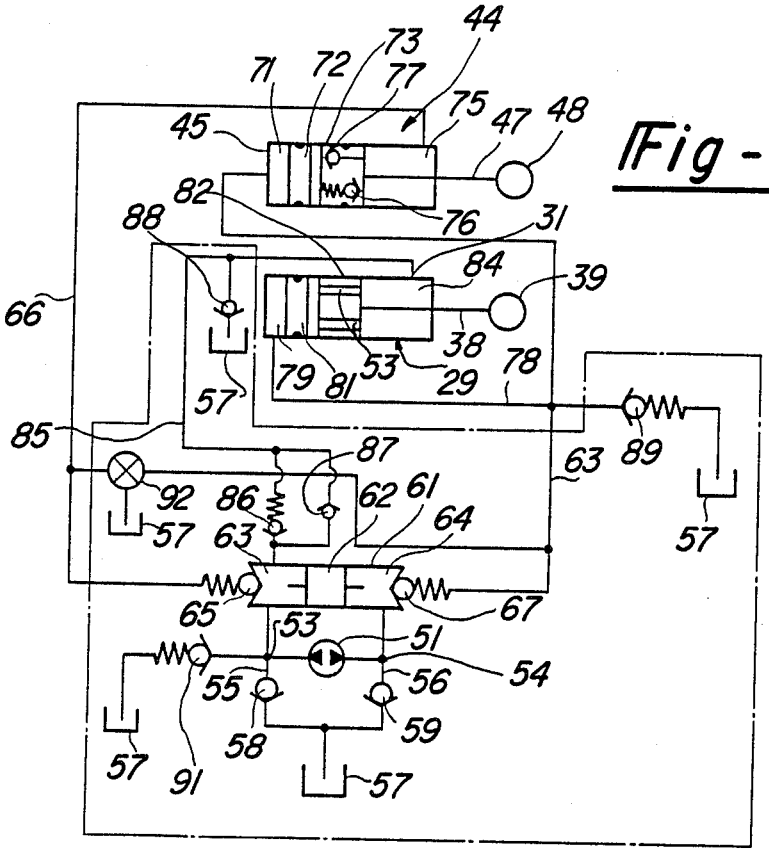
FIG. 6 is a schematic hydraulic circuit of the embodiment shown in FIGS. 1 through 5.

FIGS. 5 and 6 show the arrangement wherein the fluid pump 51 and fluid motor 52 as well as the associated components can be conveniently and compactly carried between the supporting brackets 21 in a somewhat nested fashion. As may be seen therein, the valve components are located within a base assembly to which the motor/pump combination is located and a plurality of external fluid lines 101 and 102 are provided for connecting the hydraulic components to the various cylinders. In addition, an electrical conductor 103 runs from the motor 52 back into the interior of the associated watercraft for control purposes. A fastener 104 connects the conductor 103 to the link 27 for convenience. Furthermore, a trim position sensor 105 cooperates with a cam device 106 so as to provide an indication of trim position.

In many regards, the system as thus far described may be considered to be similar to that disclosed in copending application Ser. No. 672,410. However, the system shown in that patent application has a path of movement of the outboard motor 11 relative to the supporting bracket 21. Although this may be acceptable for a single installation, if circumstances vary such as would result in installation on other watercrafts or in different environments, the specific path of movement accommodated by the linkage system might not be the optimum for all conditions. Therefore, an arrangement is provided in accordance with this invention wherein the path of movement may be adjusted so as to accommodate such varying purposes.

For this reason, the pivot pin 27 is selectively received in any of a plurality of apertures 107 (FIGS. 2 and 4) that are formed in the brackets 21 so as to facilitate adjustment of the path of movement. The apertures 107 lie on an arc a struck from the pivot axis defined by the pin 28 through the length of the link 26 between the pivot pins 27 and 28 so that regardless of which of the apertures 107 is employed, the trim down position of the outboard motor 11 will stay the same. As may be seen from FIG. 2, however, when one of the apertures 107 (B) is employed, the path of movement of the link 26 will follow the arc b while if the other aperture (A) is used, the arc a will be followed. Hence, there can be an adjustment in the path of movement through the expedient of moving the pin 27 to selected ones of the apertures 107 (A or B). Thus, a wider latitude of range of movements is possible than with the prior art constructions wherein all of the pivot axes are fixed relative to each other.

Figure 7:
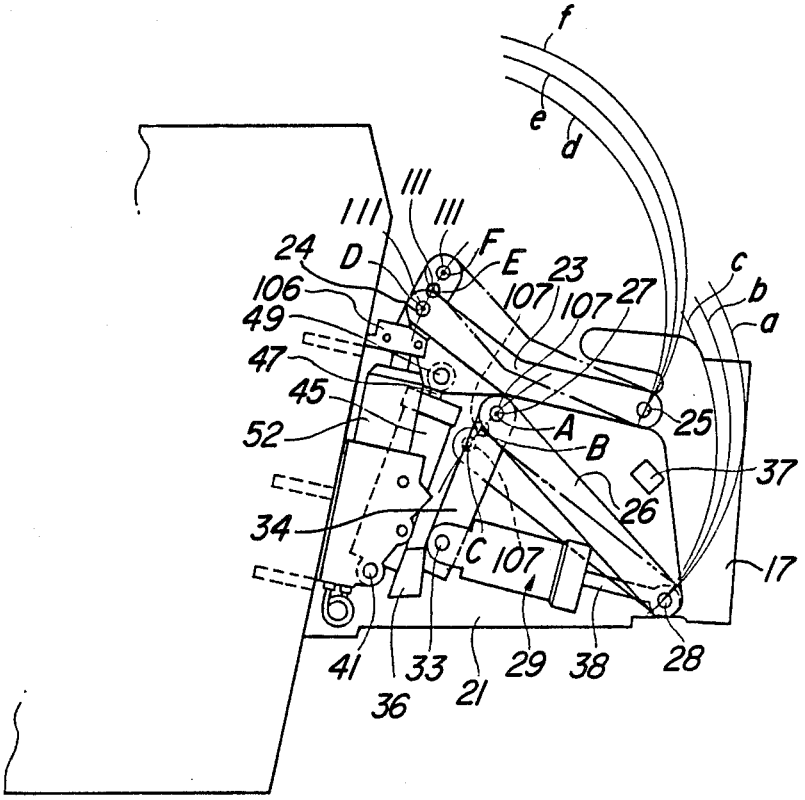
FIG. 7 is a side elevational view, in part similar to FIG. 2, showing a second embodiment of the invention.

In the embodiment thus far described, there is a greater latitude of path of movement of the outboard drive relative to the associated watercraft transom than with the prior art constructions having pivot axes that are fixed relative to each other. FIG. 7 shows a further embodiment of the invention wherein even greater latitude in the ranges of movement are possible.

This embodiment is substantially the same as the previously described embodiment but a greater range of pivot points are provided. Because of the similarity, those components which are the same as the previously described embodiment have been identified by the same reference numerals and will not be described again. In this embodiment, there are provided three apertures 107 for receiving the pivot pin 27. These apertures are indicated at A, B and C which lie along an arc drawn from the pivot point 28 to the pivot pin 27 of the length of the link 26. As a result, regardless of which pivot pin opening A, B or C is chosen, the fully trimmed down position of the outboard motor 11 will be the same. It will be noted, however, that the pivot points A, B and C give arcs of movement a, b, and c which differ from each other.

In addition, the pivot pin 24 that provides the pivotal connection between the link 23 and the supporting bracket 21 can be received in any of a plurality of apertures 111. The apertures 111 have respective locations D, E and F that lie along an arc circumscribed from the lower most position of the pin 25 to the pivot pin 24. As a result, which of the aperture openings D, E and F is chosen will not alter the trim down position of the outboard motor 11. However, as shown by the arcs d, e and f, the path of movement of the pivot pin 25 will vary upon which aperture is chosen and thus an even greater latitude in movement is possible.

Figure 8:
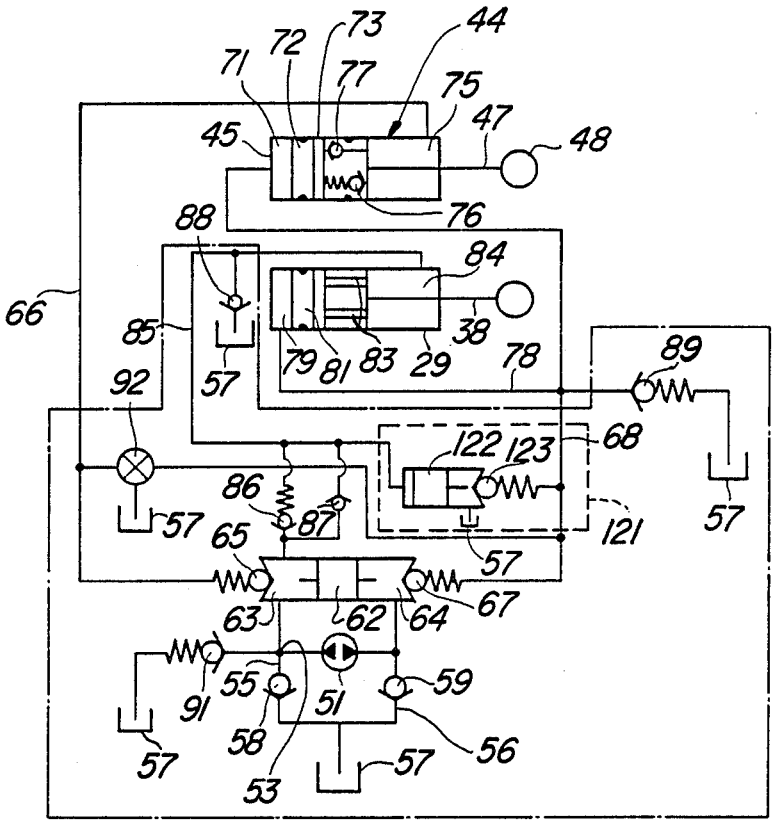
FIG. 8 is a schematic hydraulic circuit, in part similar to FIG. 6, showing yet another embodiment of the invention.

FIG. 8 shows a still further embodiment of the invention and specifically an improvement in the hydraulic circuitry that facilitates rapid tilt and trim down movement. It should be noted from the embodiment of FIG. 6, during tilt and trim down movement, all of the return fluid from the chambers 71 and 69 of the trim fluid motor 44 and tilt fluid motor 29 must pass through the line 68 and opened check valve 67. The embodiment of FIG. 8 is designed so as to cause more rapid tilt down movement and this embodiment employs a quick tilt and trim down valve assembly, indicated generally by the reference numeral 121. Outside of this, the construction is the same as the previously described embodiment and those components of the hydraulic circuit which are the same as the previously described embodiment have been identified by the same reference numerals and will not be described again except insofar is necessary to understand the construction and operation of this embodiment.

The tilt and trim down valve assembly 121 includes a shuttle piston 122 which is slidably supported within a chamber that receives pressure from the line 85 between the chamber 84 of the trim cylinder assembly 29 and the check valves 86 and 87. When this shuttle piston 125 is pressurized, it will open a check valve 123 that interconnects the line 68 directly with the reservoir 57 without having to flow through the shuttle valve assembly including the piston 62. Hence, when the chamber 84 is pressurized for tilt down operation, the check valve 123 will open and fluid can be rapidly received from the tilt cylinder chamber 71 and the trim cylinder chamber 79 so as to achieve fast tilt and trim down operation. In other regards, this embodiment is the same as the embodiment of FIG. 6 and, therefore, further description of the operation of this embodiment is not believed to be necessary.

It should be readily apparent from the foregoing description that a number of embodiments of the invention have been illustrated and described each of which provides for a wide latitude of movements of the outboard drive relative to the transom of the associated watercraft. In addition, because of the linkage systems employed, the outboard drive will tilt through a substantial vertical distance without occupying a substantial horizontal distance as with conventional single pivot axis support. Although a number of embodiments of the invention have been illustrated and described, various changes and modifications may be made without departing from the spirit and scope of the invention, as defined by the appended claims.

We claim:

1. In a marine outboard drive carrying propulsion means, supporting means for supporting said outboard drive for movement relative to the transom of an associated watercraft through a plurality of trim adjusted positions, the improvement comprising said supporting means comprising linkage means including at least one link having pivotal connections to said outboard drive and said transom, the location of one of said pivotal connections being adjustable for varying the path of movement of said outboard drive in response to adjustment of the location of said pivotal connection.

2. In a marine outboard drive as set forth in claim 1 wherein the location of the pivotal connection is adjustable by moving the pivot point.

3. In a marine outboard drive as set forth in claim 2 wherein the pivot point is moved by providing a plurality of spaced apertures adapted to receive a pivot pin that forms the pivotal connection.

4. In a marine outboard drive as set forth in claim 3 wherein the apertures lie along an arc defined by the pivotal movement of the link about its other pivotal connection.

5. In a marine outboard drive as set forth in claim wherein the linkage system comprises a plurality of links.

6. In a marine outboard drive as set forth in claim 5 wherein there are at least two adjustable pivotal connections.

7. In a marine outboard drive as set forth in claim 6 wherein each of the adjustable pivotal connections comprise a plurality of spaced apertures adapted to receive a pivot pin that forms the pivotal connection.

8. In a marine outboard drive as set forth in claim 7 wherein the fully trimmed down position of the outboard drive is the same regardless of the condition of the adjustment of the pivotal connections.

9. In a marine outboard drive as set forth in claim 1 wherein the fully trimmed down position of the outboard drive is the same regardless of the condition of the adjustment of the pivotal connection.

* * * * *

UNITED STATES PATENT AND TRADEMARK OFFICE

CERTIFICATE OF CORRECTION

PATENT NO. : 4,781,631

DATED : November 1, 1988

INVENTOR(S) : Uchida, et al

It is certified that error appears in the above-identified patent and that said Letters Patent is hereby corrected as shown below:

Column 10, line 38, Claim 5, after "claim" insert --1--.

Signed and Sealed this

Thirteenth Day of March, 1990

*Attest:*

JEFFREY M. SAMUELS

*Attesting Officer*

*Acting Commissioner of Patents and Trademarks*